US010052008B1

(12) United States Patent
Chan

(10) Patent No.: US 10,052,008 B1
(45) Date of Patent: Aug. 21, 2018

(54) CLEANING IMPLEMENT WITH DISPOSABLE CLEANING PAD SLEEVES

(71) Applicant: Erik Stanton Chan, Orinda, CA (US)

(72) Inventor: Erik Stanton Chan, Orinda, CA (US)

( * ) Notice: Subject to any disclaimer, the term of this patent is extended or adjusted under 35 U.S.C. 154(b) by 636 days.

(21) Appl. No.: 14/163,232

(22) Filed: Jan. 24, 2014

Related U.S. Application Data

(60) Provisional application No. 61/756,720, filed on Jan. 25, 2013.

(51) Int. Cl.
*A47L 13/254* (2006.01)

(52) U.S. Cl.
CPC ..... *A47L 13/254* (2013.01)

(58) Field of Classification Search
CPC ..... A47L 13/254; A47L 13/24; A47L 13/255; A47L 13/256; A47L 13/257; A47L 13/258; A47L 13/20; A47L 13/22; A47L 13/25; A47L 13/253
See application file for complete search history.

(56) References Cited

U.S. PATENT DOCUMENTS 2,870,475 A 1/1959 Scheuer et al.
3,054,127 A * 9/1962 Petsch ..... A47L 13/25 15/244.1
3,376,595 A 4/1968 Cole
3,491,397 A * 1/1970 Hesener ..... A47L 13/24 15/118
5,071,489 A 12/1991 Silvenis et al.
5,455,980 A * 10/1995 Buchanan ..... A47L 13/24 15/147.2
5,953,784 A * 9/1999 Suzuki ..... A47L 13/20 15/145
6,101,661 A 8/2000 Policicchio et al.
6,305,046 B1 10/2001 Kingry et al.
6,405,403 B1 6/2002 McKay
6,899,485 B2 5/2005 Hall et al.
7,146,676 B2 * 12/2006 Kubes ..... A47K 11/10 15/210.1
7,735,182 B2 6/2010 Morris et al.
2002/0083964 A1 * 7/2002 McKay ..... A47L 13/18 134/6
2006/0168751 A1 * 8/2006 Lin ..... A47L 13/20 15/229.3

(Continued)

FOREIGN PATENT DOCUMENTS

KR 20040074888 A * 8/2004

*Primary Examiner* — Christopher M Koehler
*Assistant Examiner* — Joel Crandall
(74) *Attorney, Agent, or Firm* — David Pressman

(57) ABSTRACT

A two-sided mop comprises a mop head (100) that is rotatably secured to a bracket (105) which in turn is secured to a handle (110). A replaceable, sock-like cleaning pad (135) is urged onto the mop head from one end and secured there by a plurality of fingers (405) that are springably urged outward from the mop head, or by changing the shape of the mop head to stretch one end of the pad so that it is taut, or by securing the pad with fasteners. In a first embodiment, the cleaning pad is partially ejected from the head by a foot (510) that is moved by pushing on an actuator button (505). When one side of a cleaning pad is soiled, the opposite side of the cleaning pad is selected by rapid up-forward-or-backward-and then down motions of the mop.

20 Claims, 5 Drawing Sheets

(56) References Cited

U.S. PATENT DOCUMENTS

| | | | | |
|---|---|---|---|---|
| 2008/0169052 | A1* | 7/2008 | Tannijarvi | A47L 13/20 150/154 |
| 2011/0023251 | A1* | 2/2011 | Bober | A47L 13/256 15/228 |
| 2011/0131744 | A1* | 6/2011 | Mrouse | A47L 13/10 15/230 |

* cited by examiner

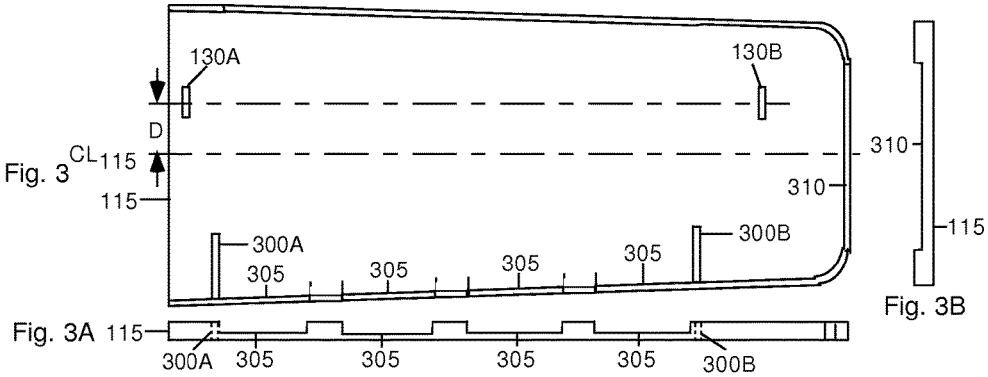
Fig. 3
Fig. 3A
Fig. 3B
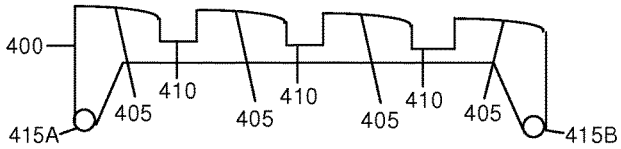
Fig. 4
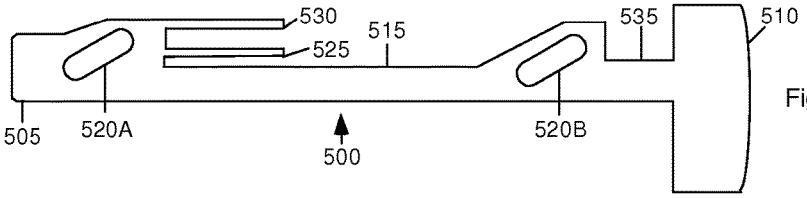
Fig. 5
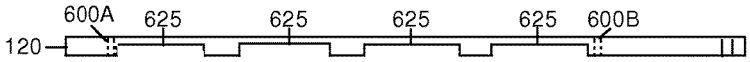
Fig. 6A
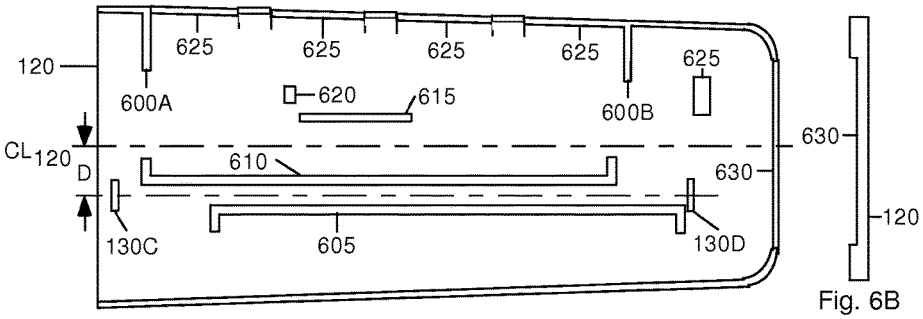
Fig. 6
Fig. 6B
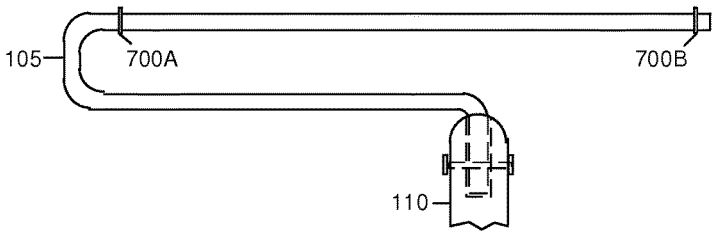
Fig. 7

CLEANING IMPLEMENT WITH DISPOSABLE CLEANING PAD SLEEVES

RELATED APPLICATION

This application claims priority of my provisional patent application, Ser. No. 61/756,720, filed Jan. 25, 2013.

BACKGROUND

Prior Art

Cleaning implements such as mops with disposable wiping pads are in common use today. They are generally lightweight and overcome some deficiencies of wet mops. Instead of dipping a mop in soapy water, squeezing out excess water, and then wiping a floor with previously used water, a disposable pad is used. The pad is lightly moistened prior or during use in order to pick up debris from a floor, but no squeezing is required. Disposable pads remove the need to reapply previously used, dirty cleaning solutions to a floor, thereby providing a cleaner surface than possible with a wet mop.

The following is a list of some possibly relevant prior art that shows various kinds of cleaning implements. Following this list I provide a discussion of these references.

| Pat. or Pub. Nr. | Kind Code | Issue or Pub. Date | Patentee or Applicant |
|---|---|---|---|
| U.S. Pat. No. 2,870,475 | B1 | 1959 Jan. 27 | Scheuer et al. |
| U.S. Pat. No. 3,376,595 | B1 | 1968 Apr. 9 | Cole |
| U.S. Pat. No. 5,071,489 | B1 | 1991 Dec. 10 | Silvenis et al. |
| U.S. Pat. No. 6,101,661 | B1 | 2000 Aug. 15 | Policicchio et al. |
| U.S. Pat. No. 6,305,046 | B1 | 2001 Oct. 23 | Kingry et al. |
| U.S. Pat. No. 6,405,403 | B1 | 2002 Jun. 18 | McKay |
| U.S. Pat. No. 6,899,485 | B2 | 2005 May 31 | Hall et al. |
| U.S. Pat. No. 7,735,182 | B2 | 2010 Jun. 15 | Morris et al. |

Scheuer shows a dusting device with a rectangular dusting head attached to a handle. A stack of soft lamina wrap around papers are stapled at the sides of the dusting head. When a paper has been used, it is torn away at a point near the staples and discarded. This device has only a single mopping surface and is suitable for use only as a dry mop.

Cole shows a mop having a pad of stacked, disposable sheets. Each sheet in the stack has a waterproof edge that is attached to a mop frame using a pair of fasteners. The remainder of the stack is formed around a sponge that is also attached to the mop frame. In use, the mop head is dipped into a cleaning solution and then scrubbed on a floor so that the exposed paper layer on the outside of the stack accumulates and traps dirt. When it is sufficiently dirty, the outer sheet is torn away from its waterproof edge and a new sheet is exposed. Although suitable for wet-mopping, his device has only a single mopping surface.

Silvenis shows a floor cleaner that uses disposable, free-edge fabric sheets. A handle is pivotally attached to a member that has a flat lower surface. The lower surface of the member comprises a plurality of bristles that hold a fabric sheet in place on the member while a user wipes a floor surface with the fabric. The fabric sheet is moistened before use, thereby eliminating the need for a mop bucket. Again, this device has only a single mopping surface.

Policicchio shows a cleaning implement that uses a removable, water absorbent cleaning pad having multiple cleaning surfaces including a scrubbing layer and an absorbent layer. As with Scheuer, Cole, and Silvenis this pad has only a single mopping surface.

Kingry shows a floor mop having a structure for retaining a sheet. A handle is pivotably attached to a generally flat, rectangular mopping structure that includes a plurality of attachment structures. The attachment structures are slits in a flexible material. In use, a cloth is wrapped around and over the top of the mopping structure. Then portions of the cloth are urged into the attachment structures by poking with a fingertip, thereby securing the cloth to the mopping structure. Again, this device provides only a single mopping surface.

McKay shows a mop with an oblate core onto which a plurality of cleaning sheets are wound. The core is rotatably supported along its axis by a shaft that is attached to a handle. During use, the core is rotated to a first position and a cleaning surface on the bottom side of the core is scrubbed on a floor. When the cleaning surface on the bottom side of the core is dirty, the core is rotated so that the dirty cleaning surface is moved to the top of the core, thereby exposing a clean cleaning surface at the bottom of the core. When both cleaning surfaces are soiled, a user peels the outer two cleaning sheets away from the core, thereby exposing a new pair of cleaning surfaces. This device provides two mopping surfaces, however when the two surfaces are soiled and to be discarded, the user must unroll them from the core.

Hall shows a mop with a handle and a cleaning head. The cleaning head has a removable cleaning pad. A fluid reservoir on the handle is connected via a hose to the cleaning head. A trigger mechanism on the handle releases cleaning fluid from the reservoir. Only a single cleaning surface is used.

Morris shows a reversible mop head assembly. A mop handle is pivotably connected to a transverse support shaft that holds a pair of end caps that hold a support surface. A removable cleaning substrate comprising a sleeve that is open at both ends is secured to the support surface. In use, a first side of the cleaning substrate is scrubbed on a floor until it is soiled. Then the support surface and end caps are urged to pivot about the support shaft so that a second side of the cleaning substrate is made available for scrubbing. When both surfaces of the cleaning substrate are soiled, the substrate is removed and replaced by a new one. In one embodiment, a cleaning substrate comprises a tubular sleeve. The sleeve is installed by springably pulling and then rotating one end cap so that the end of the support surface is exposed, slidably moving the sleeve onto the support surface, and then returning the end cap to its original position where it grips the end of the support surface. Although this mop assembly provides two cleaning surfaces, replacement of the cleaning substrate requires several steps, i.e., pulling and then rotating an end cap to disconnect it from the support surface, sliding the soiled cleaning substrate off the support surface, sliding a new cleaning substrate onto the support surface, and then pulling and rotating the end cap until it is aligned with the support surface, where it is released and once again springably engages the support surface. Also, the pivoting connection between the mop head and handle is behind or along one edge of the mop head, so that is difficult to apply firm downward pressure on the mop head and cleaning pads, which is desirable when scrubbing floors. Further, the sleeve must be secured against pull-off in both directions.

SUMMARY

An improved cleaning apparatus for use in mopping or scrubbing surfaces comprises a mop head pivotally attached to a bracket that in turn is secured to a handle. The bracket is shaped and positioned so that force applied to the handle is applied away from the edge and near the center of the mop head for improved scrubbing. A sock-like disposable cleaning pad is slidably installed on the mop head and secured thereon for use, then easily removed when it is soiled. No screw fasteners are used to hold the cleaning pad in place. The mop has two mopping surfaces that are selectable by simply raising a first mopping surface from a floor and swinging the mop so that the mopping head pivots on the bracket and a second mopping surface can be lowered to the floor for use. Thus a user replaces the mopping surface half as often as with a single mopping surface. In various aspects, the cleaning pad is secured to the mop head in preparation for use by a securing strap, by changing the shape of the mop head, or engaging a plurality of fingers that extend from a margin of the mop head. In various aspects, the pad is removed from the mop head by manually opening a securing strap, manually changing the shape of the mop head, or activating an ejection mechanism.

DRAWING FIGURES

FIGS. 3 through 7 are plan and elevation views of the component parts of the embodiment of FIGS. 1 and 2.

DRAWING REFERENCE NUMERALS

| | | | |
|---|---|---|---|
| 100 | Mop head | 105 | Bracket |
| 110 | Handle | 115 | Upper portion |
| 120 | Lower portion | 122 | Seam |
| 125 | Opening | 130 | Slot |
| 135 | Cleaning pad | 140 | Surfaces |
| 145 | Edge | 150 | Opening |
| 155 | Arrow | 160 | Fastener |
| 165 | Hole | 300 | Guide |
| 305 | Opening | 310 | Opening |
| 400 | Slide | 405 | Fingers |
| 410 | Slots | 500 | Actuator |
| 505 | Button | 510 | Foot |
| 515 | Shaft | 520 | Angled slots |
| 525 | Slot | 530 | Slot |
| 535 | Slot | 600-615 | Guides |
| 620-625 | Stops | 630 | Opening |
| 700 | Washer | 800 | Spring |
| 900 | Arrow | 910 | Arrow |
| 1000 | Hinge portion | 1005 | Hinge pin |
| 1010 | Lever | 1015 | Post |
| 1020 | Wedge | 1025 | Notch |
| 1030 | Notch | 1100 | Arrow |
| 1200 | Arrow | 1300 | Fastener |
| 1305 | Fastener | | |

DESCRIPTION—FIRST EMBODIMENT—FIGS. 1 THROUGH 9

Figure 1:
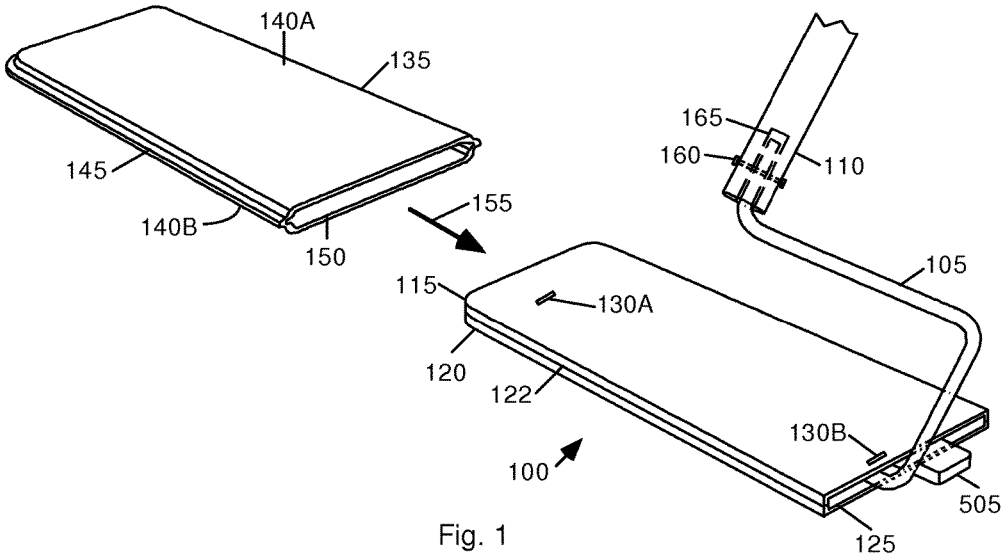
FIGS. 1 and 2 are perspective views of one aspect of a first embodiment.

One aspect of a first embodiment is shown in FIGS. 1 through 9. FIG. 1 shows a perspective view of a mop head 100 and a cleaning pad 135 in preparation for assembly before use.

Mop head 100 is rotatably secured to a bracket 105 which in turn is secured to a mop handle 110. Head 100 comprises an upper rectangular portion 115 and a lower rectangular portion 120. Portions 115 and 120 each comprise a flat panel with depending side portions that extend, respectively, perpendicularly halfway down or up to the other panel, as shown. The perpendicular sides of the two portions are joined together in a clam-shell arrangement that is closed around the periphery of mop head 100 except for an opening 125 at a first end. When head 120 is fully assembled and ready for use, upper portions 115 and 120 are permanently joined together along a seam 122 by using fasteners, gluing, ultrasonic welding, heat welding, spot welding, or another means.

Portions 115 and 120 of head 100 include a plurality of slots 130A and 130B. The purpose of these slots is discussed below. Mop head 100 further includes a push-button 505 that is part of an internal mechanism, also discussed below.

Cleaning pad 135 comprises a generally rectangular, flattened sleeve having upper and lower surfaces, 140A and 140B, respectively. Surfaces 140A and 140B are joined together along an edge 145 around two longitudinal sides and one end of pad 135. Thus the longitudinal sides and the one end of pad 135 at the upper left are closed or fastened by an integral fabric fold, sewing, gluing, welding, etc. Also these sides and end need not have a continuous closure but can be closed or fastened by straps, snaps, buttons and holes, hooks and eyes or anchor loops, hook-and-loop fasteners, etc. The fourth side of pad 100 opposite the closed or fastened and at the lower right is fully open at an opening 150 that extends across the end so that the pad can be slipped onto head 100.

Pad 135 is sized to slide over mop head 100, as indicated by arrow 155. Pad 135 is installed onto head 100 by inserting the free end of mop head 100 into opening 150 of pad 135 and slidably urging pad 135 toward the right-hand end of mop head 100 until pad 135 and mop head 100 are fully engaged.

Figure 2:
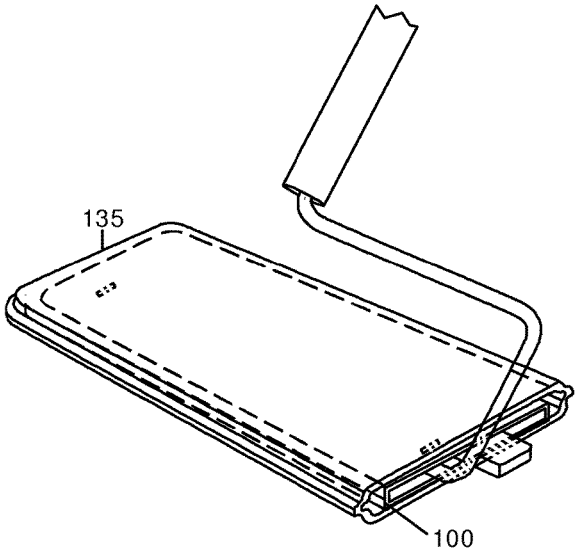

FIG. 2 shows pad 135 fully installed on mop head 100, ready for use.

Pad 135 is made of fabric comprising cotton, nylon, rayon, polyester, or another porous material such as sponge, plastic foam, rubber foam, or a combination of these materials. Seam 145 is formed by ultrasonic or heat welding, stitching, gluing. Instead of an all-around seam on three sides as shown, two or more sheets can be folded and a seam formed along only one side and an end. Alternatively, pad 135 is formed by dip-molding, well-known to those skilled in the art of making rubber gloves and mitts.

Thus the mop head has upper and lower opposing surfaces, each of which has a relatively long length and a relatively short width and a thickness between said upper and lower surfaces that are less than the width. The cleaning pad comprises a sleeve of flexible material having upper and lower surfaces with one closed or fastened end and an opposite open end. The sleeve is sized and shaped so that it can be slid over the mop head, open end first, so that it will conformingly fit over and cover or enclose the mop head. The mop head includes means for attaching the cleaning pad to the mop head for preventing said cleaning pad from sliding off after it is slid onto the head. The attachment means comprises expandable halves of the head, fingers that expand, or fastening tabs.

Head 100 is made by casting or injection molding of any suitable plastic material such as acrylonitrile butadiene styrene (ABS), nylon with or without reinforcing materials such as glass or another fiber, polybutylene terephthalate, or another plastic. Alternatively, head 100 can be made of a metal such as steel or aluminum that is formed by casting or stamping.

Bracket 105 is formed of stiff steel wire that is about 0.8 cm diameter. Handle 110 is made of wood, plastic, or metal tubing. One or more fasteners 160 secures the top end of bracket 105 within a pre-drilled hole at the lower end of handle 110. Alternatively, the top end of bracket 105 is secured within hole 165 in handle 110 by threads, glue, or a combination thereof.

In one version head 100 is 36 cm long, 10 cm wide, and 1 cm thick, although other dimensions can be used. The remainder of the components shown in FIG. 1 scale accordingly as shown.

Components—FIGS. 3 through 7.

FIGS. 3 through 7 show plan views of the various component parts of mop head 100. FIG. 3 shows a plan view of the inside of upper portion 115 with slots 130A and 130B. A pair of guides 300A and 300B are formed integrally within portion 115. An opening 310 is formed at the right-hand end of portion 115. FIG. 3A is a side view of portion 115 that shows a plurality of openings 305 that are formed along the lower edge of portion 115. FIG. 3B is an end view of portion 115 showing opening 310. The purposes of the guides and openings are explained below.

FIG. 4 shows a plan view of a slide mechanism 400. Slide 400 comprises a plurality of fingers 405 and slots 410. A pair of fingers 415A and 415B extend perpendicular to the surface of slide 400.

FIG. 5 shows a plan view of an actuator mechanism 500. Actuator 500 comprises a button portion 505 at the left end and a foot portion 510 that are joined by a shaft portion 515. Shaft 515 includes a pair of angled slots 520A and 520B, parallel horizontal slots 525, 530, and a vertical slot 535.

FIG. 6 shows a plan view of the inside of lower portion 120 of head 100. Slots 130C and 130D lie directly opposite slots 130A and 130B (FIG. 3) when mop head 100 is assembled. A pair of guides 600A and 600B lie directly opposite guides 300A and 300B, respectively, when mop head 100 is assembled. Additional guides 605, 610, and 615, and stops 620 and 625 are also shown. An opening 630 is included at the right-hand end of portion 120. Opening 630 complements and is adjacent to opening 310 when mop head 100 is assembled. The purposes of these various parts are each shown and described below.

Figure 9:
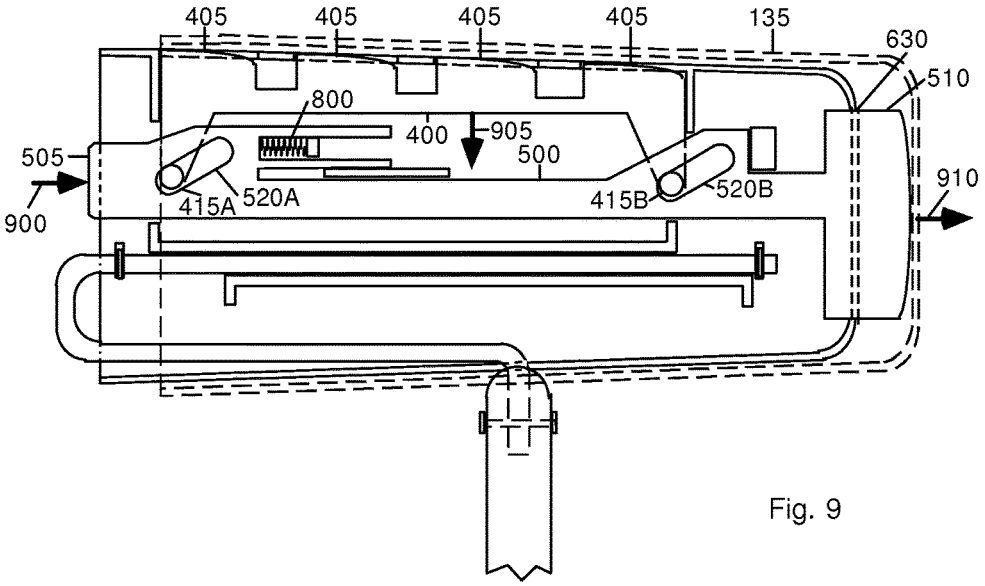

The center lines $CL_{115}$ and $CL_{120}$ of portions 115 and 120, respectively, lie a distance D from the centers of slots 130A and 130B in portion 115, and the same distance D from the centers of slots 130C and 130D in portion 115 of mop head 100. The distance D is about 1 cm, although other distances can be used. As explained below, washers 700A and 700B on bracket 105 are inserted in slots 130A-130C and 130B-130D, respectively, so that bracket 105 is rotatably secured within head 100. Thus, as shown in FIG. 9, bracket 105 will lie along an axis that extends between the opposite ends of the enclosure and is offset from the centerlines of portions 115 and 120 and thus the center of the enclosure. Handle 110 is perpendicular to this axis and the length of head 100 and the enclosure formed by such head. Thus when head 100 is lifted above a surface, gravitational force will urge head 100 to rotate about bracket 105 until the side containing notches 305 and 625 hangs downward. When this is the case, a sudden forward motion of mop head 100, followed by quickly lowering head 100 to the surface will cause a first side of head 100 to be in contact with the surface. A sudden reverse motion of head 100, followed by quickly lowering head 100 to the surface will cause the other side of head 100 to be in contact with the surface. Thus a user saves time by using both sides of cleaning pad 135.

FIG. 7 shows a plan view of bracket 105 and handle 110. A pair of circular washers 700A and 700B are secured to bracket 105 at the positions shown by swaging, soldering, brazing, welding, or gluing. The spacing between washers 700A and 700B is the same as the spacing between slots 130A and 130B, and between slots 130C and 130D.

All components in FIGS. 3 through 7 are scaled to their relative sizes when assembled into mop head 100. Although the upper and lower sides of portions 115 and 120 are shown as gently sloping toward the right-hand end of mop head 100, they can also be parallel.

Figure 8:
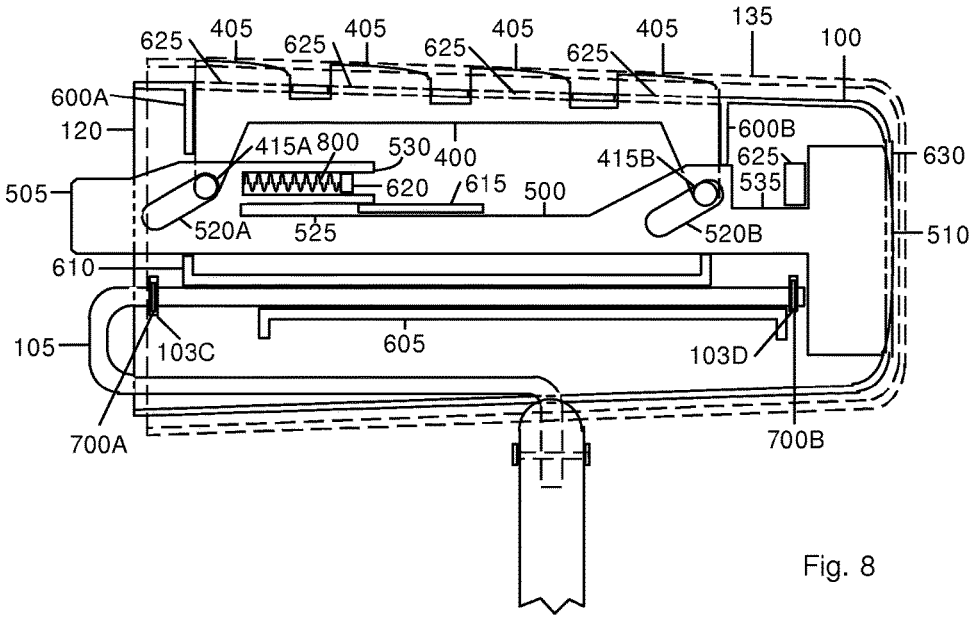
FIGS. 8 and 9 are plan views of a partially assembled first embodiment.

Assembly—FIG. 8.

FIGS. 8 and 9 are plan views of bottom portion 120 with the above-described component parts assembled in their relative positions. Top portion 115 is removed in these views for clarity. A cleaning pad 135 is shown in place on mop head 100 by dashed lines.

FIG. 8 shows head 100 with actuator 500 at a first position. Slide 400 is laid in contact with portion 120 with fingers 405 extending outward through slots 625. Guides 600A and 600B and slots 625 constrain slide 400 to move in a vertical direction only.

Actuator 500 is laid on top of slide 400 and initially positioned so that slots 520A and 520B capture fingers 415A and 415B of slide 400. Slot 525 of actuator 500 slidably engages guide 615 of portion 120, thereby permitting only horizontal, side-to-side, motion of actuator 500. Side-to-side-only motion of actuator 500 is ensured by guide member 610 as actuator 500 moves against guide 610 and by slot 535 as it moves slidably past stop 625.

FIG. 8 shows actuator 500 at its left-most position. Actuator 500 is prevented from moving farther to the left by stop 625 as it rests against the right-hand side of slot 535, and by fingers 415A and 415B as they rest at the right-hand ends of slots 520A and 520B, respectively, since slide 400 is constrained to move only up and down. While actuator 500 is at its left-most position, button 505 extends outward through opening 125 (FIG. 1) of mop head 100.

A compression spring 800 bears on the left-hand end of slot 530 and the left-hand side of stop 620. Spring 800 urges actuator 500 to move toward its left-most position. When this is the case, foot 500 is withdrawn within mop head 100 at opening 630 (and also opening 310 in portion 115 of mop head 100) and fingers 405 extend fully outward from mop head 100 and engage the inner surface of cleaning pad 135, thereby securing pad 135 on mop head 100 for use.

Bracket 105 is laid between guides 605 and 610 so that washers 700A and 700B rotatably extend part way into slots 130C and 130D. When portions 115 and 120 of head 100 are assembled, washers 700A and 700B also rotatably extend part way into slots 130A and 130B, respectively. Thus with guides 605 and 610 and slots 130A through 130D, bracket 105 is rotatably secured within mop head 100.

Operation—FIG. 9.

FIG. 9 shows a plan view of bottom portion 120 and all internal components in position. A cleaning pad 135 is shown in dashed lines as it is partially ejected from head 100. In the following, upper portion 115 of mop head 100 is removed for clarity to show the operation of moving parts in this discussion. However portion 115 is normally present and sealed to lower portion 120 of head 100 after manufacture and during use.

Head 100 is prepared for use as shown in FIG. 2. Cleaning pad 135 is fully installed over head 100 and is held in place by fingers 405, which are in an expanded position against the inside of pad 135, thereby providing a holding part (securing means) for preventing pad 135 from sliding off the head. As shown in FIGS. 4 and 8, fingers 405 have corners that are relatively sharp on their left sides (facing opposite the direction from which pad 135 is removed) and that are rounded and lower on their right sides (facing the direction from which pad is slid on). As also shown, fingers 405, pad 135, and the mop head all taper down from left to right (FIGS. 3, 4, 8, and 9). After mopping if pad 135 is soiled, it is removed as shown in FIG. 9. Button 505 is pushed in the direction shown by arrow 900, urging actuator 500 to move to the right. When actuator 500 moves to the right, slots 520A and 520B urge fingers 415A and 415B, and therefore slide 400 and fingers 405, to move downward in the direction shown by arrow 905. This removes the force between the inside of pad 135 and fingers 405, thereby releasing the grip of fingers 405 on pad 135. At the same time, foot 510 moves outward to the right through slot 630, as indicated by arrow 910, and presses against the inside of the right-hand end of pad 135, thereby urging pad 135 to move off or eject head 100 so that it is easily pulled off and away by a user (not shown).

When a user releases button 505, spring 800 urges actuator 500 to its left-most position, preparing mop head 100 for dressing with a new pad 135.

DESCRIPTION AND OPERATION—FIRST ALTERNATIVE EMBODIMENT—FIGS. 10 THROUGH 12

Figure 10:
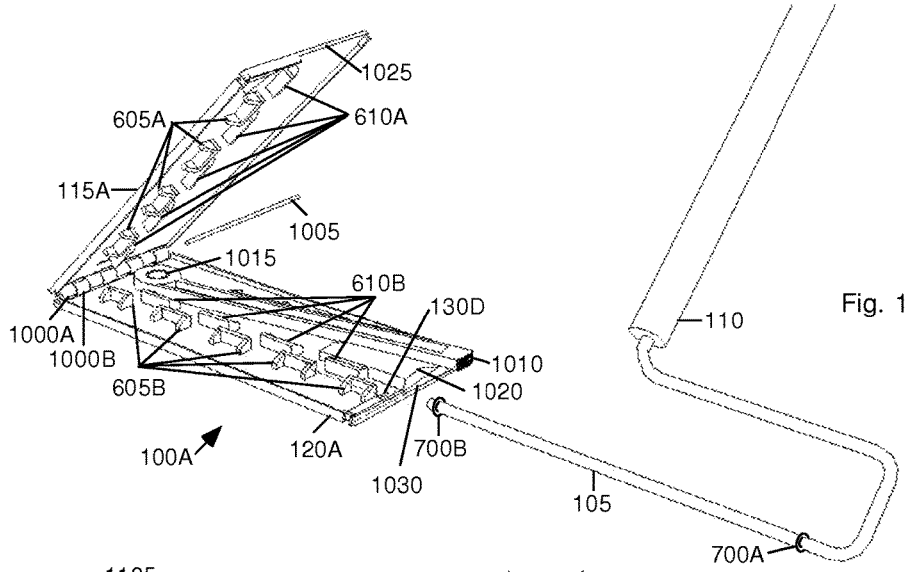
FIG. 10 is a perspective view of a partially assembled second embodiment.
Figure 11:
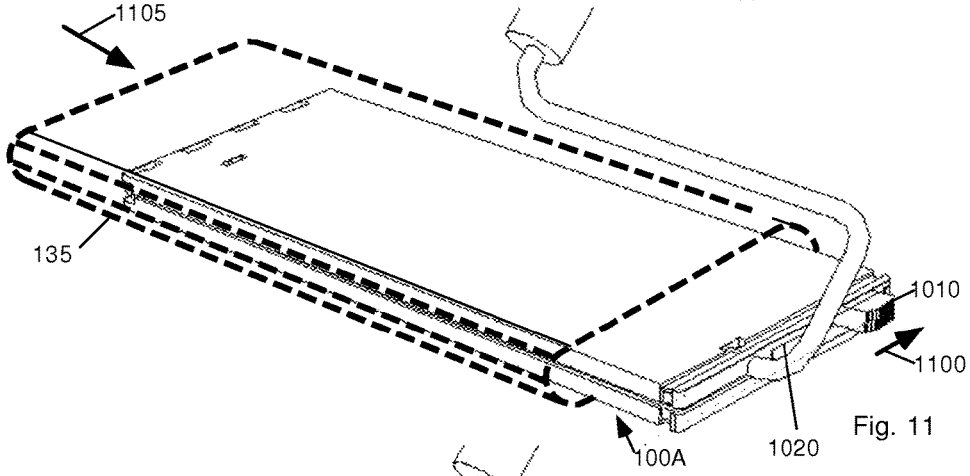
FIGS. 11 and 12 show the embodiment of FIG. 10 being prepared for use.
Figure 12:
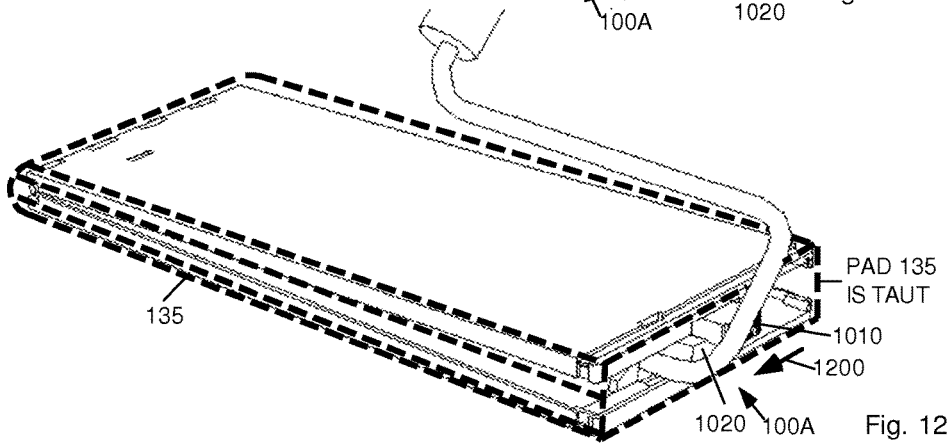

FIGS. 10 through 12 show aspects of an alternative embodiment. FIG. 10 shows a perspective view of a mop head 100A comprising an upper portion 115A and a lower portion 120A. A hinge portion with knuckles 1000A and 1000B is fashioned at the end of each of portions 115A and 120A. The knuckles of the two hinge portions are secured with a hinge pin 1005, in well-known fashion. A linearly arranged plurality of guides 605A and 605B are formed as extensions that rise above the inner surface of portions 115A and 120A, respectively, of head 100A. Another linearly arranged plurality of guides 610A and 610B are formed as extensions that also rise above the inner surface of portions 115A and 120A, respectively, of head 100A.

Slots 130A through 130D (only slot 130D is shown) are positioned in portions 115A and 120A to receive washers 700A and 700B, as shown above in connection with the first embodiment. The upper end of bracket 105 is secured within mop handle 110 as shown previously.

The present embodiment incorporates a lever 1010 that is rotatably secured to a post 1015. The end of lever 1010 nearest slot 130D extends a predetermined distance beyond the right-hand end of portion 120A. This distance is about 1 cm although other distances can be used. A wedge 1020 rises above the inner surface of portion 120A so that when lever 1010 is rotated clockwise the end of lever 1010 rides up to the top of wedge 1020.

Two notches 1025 and 1030 are formed into the right-hand ends of portions 115A and 115B. When portions 115A and 120A are closed together for normal use of mop head 100A, notches 1025 and 1030 form a channel that slidably encloses lever 1010, limiting its rotational travel to within the channel so formed.

FIG. 11 is a perspective view showing the embodiment of FIG. 10 in a closed condition and ready to receive a cleaning pad. Lever 1010 is moved off of ramp 1020, toward the right-hand side of mop head 100A as indicated by arrow 1100, thus permitting portions 115A and 120A of head 100A to come together, thereby reducing the overall height of head 100A, especially at the right-hand end as shown in FIG. 11. Cleaning pad 135 is slidably urged over head 100A by moving it in the direction indicated by arrow 1105.

FIG. 12 is a perspective view showing the same embodiment in a relatively open or expanded condition. Cleaning pad 135 is fully installed on head 100A and lever 1010 is moved to its left-most position on the top of ramp 1020, as indicated by arrow 1200. With lever 1010 in this position, the right-hand end of pad 135 is stretched to a taut condition and thus held captive on head 100A where it is ready for use.

Dimensions, materials, and scaling of the present embodiment are the same or similar to those shown above for the first embodiment.

Thus in the first embodiment and the first alternative embodiment, the mop head comprises a pad-holding enclosure 100 or 100A having a pair of generally parallel upper and lower opposing flat or planar panels that are spaced apart by a predetermined thickness. Each of the panels has first and second opposite ends which are spaced relatively far apart and a relatively short width that extends normal to the length between opposite third and fourth opposite ends. The enclosure has two pairs of opposite sides extending between said third and fourth opposite ends and the first and second opposite ends of the panels. The heights of the sides are substantially the same as the predetermined thickness, which is less than said width of the enclosure. The inside of the enclosure includes a holding mechanism for selectively securing the cleaning pad to the enclosure for preventing the pad from sliding off. The holding mechanism can be either (1) width-expanding means comprising elements 400 and 500 for expanding at least one of the sides of the enclosure against an inside of the cleaning pad so as to increase the width of the enclosure to prevent the pad from sliding off, or (2) thickness-expanding means comprising lever 1010, wedge 1020, and the hinge with knuckles and pin 1005 for expanding the panels further apart so as to increase the thickness of the enclosure to secure the pad to the enclosure.

DESCRIPTION AND OPERATION—SECOND ALTERNATIVE EMBODIMENT—FIG. 13

Figure 13:
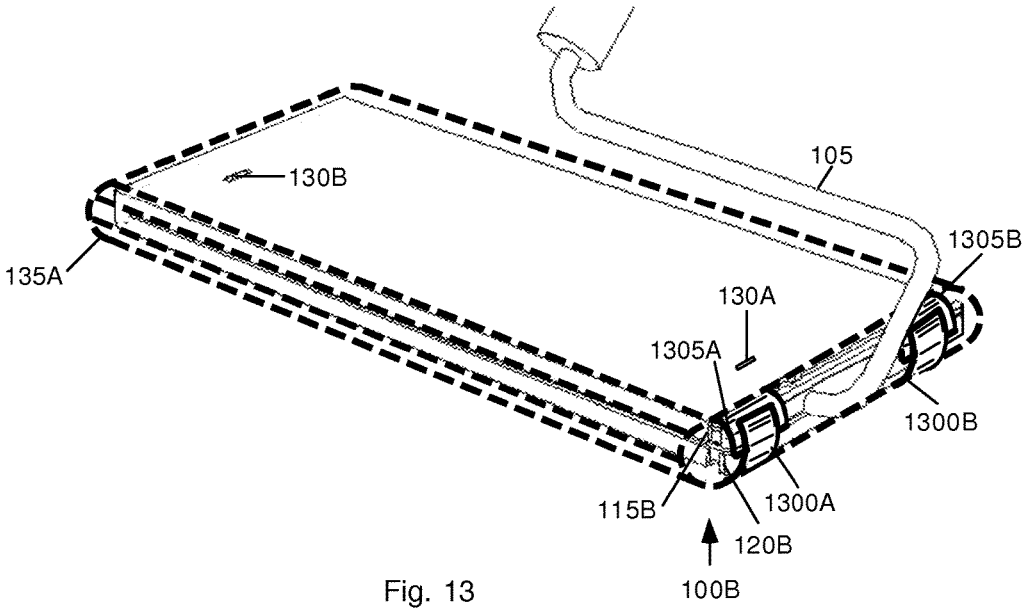
FIG. 13 is a perspective view showing one aspect of a third embodiment.

FIG. 13 shows one aspect of another embodiment. Mop head 100B comprises two permanently joined upper and lower portions 115B and 120B. Bracket 105 is pivotably secured within portions 115B and 120B by washers 700A and 700B (not shown in this view) that engage slots 130A and 130B in top portion 115B and slots 130C and 130D (not shown in this view), as in the previous embodiments.

In this embodiment, pad 135A includes fasteners at its open end. To prepare head 100 for use, pad 135A is slidably urged fully onto head 100 and then secured on a first side by tabs 1300A and 1305A and on a second side by tabs 1300B and 1305B. Tabs 1300A and 1300B are one side of hook-and-loop fasteners, for example the hook side, and tabs 1305A and 1305B are the opposite side of hook-and-loop fasteners, for example the loop side. The loop sides of tabs 1305A and 1305B face outward, away from head 100, and the hook sides of tabs 1300A and 1300B face inward, toward head 100. Tabs 1305A and 1305B are folded downward first, then tabs 1300A and 1300B are folded upward and pressed against tabs 1305A and 1305B, respectively. Alternatively, adhesive tape, fabric snaps, or cords that are tied can be used. In another aspect, fasteners may secure the cleaning pad pouch to the mop head itself. These fasteners constitute means for securing the cleaning pad to the mop head.

CONCLUSIONS, RAMIFICATIONS, AND SCOPE

The present method and apparatus provide a mop and cleaning pad with two cleaning surfaces that are easily selectable. When a first cleaning surface of the pad is soiled, a second cleaning is selected by lifting the mop upward, moving the handle and mop head rapidly in one direction while quickly lowering the mop head to the floor. Moving the handle forward selects a first cleaning surface and, moving the handle backward selects a second cleaning surface. The cleaning pad is generally a sleeve that slidably fits on the mop head. In various embodiments the pad is secured on and prevented from sliding off the mop head by various alternative securing means, including providing a plurality of fingers that extend outward from the mop head, changing the shape of the mop head so as to increase the thickness at one end, thereby tightening the cleaning pad on the mop head, and using fasteners. The cleaning pad is easily removed from the mop head in a first embodiment by pushing an actuator button, thereby withdrawing the fingers that push against the inside of the pad in the during use while simultaneously urging the cleaning pad off the mop head with a foot, or in a second embodiment by decreasing the thickness of the mop head at one end, and in a third embodiment by separating the fasteners that hold the cleaning pad in place on the mop head.

While the above description contains many specificities, these should not be construed as limitations on the scope, but as exemplifications of some present embodiments. Many other ramifications and variations are possible using the system and methods described. For example, the mop head and cleaning pad can be supplied in a variety of sizes and in square and rectangular shapes. They can be supplied in a range of colors. The cleaning pads can be made of coarse or fine, natural or synthetic fabrics, or they can be sponges or abrasive pads. Thus the scope should be determined by the appended claims and their legal equivalents, rather than the examples and particulars given.

The invention claimed is:

1. A mop head and a removable cleaning pad therefor, comprising, (a) a pad-holding enclosure having a pair of generally parallel upper and lower opposing flat or planar panels that are spaced apart by a predetermined thickness, (b) each of said panels having first and second opposite ends, said opposite ends being spaced relatively far apart to define a length of said enclosure, (c) said panels having a relatively short width normal to said length and between opposite third and fourth sides of said panels, said width being less than said length, (d) said pad-holding enclosure having a first pair of opposite sides extending between said third and fourth opposite sides of said panels, said first pair of opposite sides of said enclosure being perpendicular to said panels, the heights of said first pair of opposite sides of said enclosure having substantially the same height as said predetermined thickness, said predetermined thickness being less than said width of said panels, (e) said pad-holding enclosure having a pair of opposite ends extending between said first and second opposite ends of said panels, said pair of opposite ends of said enclosure being perpendicular to said panels, the heights of said pair of opposite ends being substantially the same as said predetermined thickness, (f) an elongated handle pivotally attached to one of said pair of opposite ends of said enclosure, said handle being perpendicular to said length of said enclosure, (g) a cleaning pad comprising a sleeve of flexible material having upper and lower parallel surfaces with one closed or fastened end and an opposite open end, (h) said sleeve being sized and shaped so that (1) its open end can be slid over the other of said pair of opposite ends of said enclosure, opposite to said one end of said enclosure to which said elongated handle is attached, and then the length of said pad-holding enclosure, and (2) said cleaning pad will conformingly fit over and cover or enclose said pad-holding enclosure with said upper surface of said cleaning pad covering substantially said entire upper panel of said pad-holding enclosure and said lower surface of said cleaning pad covering substantially said entire lower panel of said pad-holding enclosure, (i) said pad-holding enclosure including a securing mechanism for selectively either (1) securing said cleaning pad to said pad-holding enclosure for preventing said cleaning pad from sliding off said enclosure after it is fit over and covers or encloses said enclosure, or (2) allowing said cleaning pad to slide off said enclosure, said securing mechanism being selected from the group consisting of (A) width-expanding means for expanding at least one of said sides of said pad-holding enclosure out against an inside of said cleaning pad so as to increase the width of said pad-holding enclosure, and (B) thickness-expanding means for expanding said flat or planar parallel upper and lower opposing panels further apart so as to increase the thickness of said pad-holding enclosure, thereby to secure said cleaning pad to said pad-holding enclosure.

2. The mop head and removable cleaning pad of claim 1 wherein said width-expanding means comprises at least one finger inside said pad-holding enclosure and extending means inside said enclosure for extending said finger out from one of said first pair of sides of said enclosure against the inside of the cleaning pad so as to increase the width of said enclosure and thereby secure said cleaning pad to said enclosure.

3. The mop head and removable cleaning pad of claim 2 wherein said securing mechanism further includes a manually operable member extending from said pad-holding enclosure, said width-expanding means being responsive to movement of said manually operable member for extending said finger out of one of said first pair of sides of said enclosure.

4. The mop head and removable cleaning pad of claim 2 wherein said width-expanding means comprises a plurality of fingers inside said pad-holding enclosure, said width-expanding means being arranged to extend said plurality of fingers out from one of said first pair of sides of said enclosure against the inside of the cleaning pad.

5. The mop head and removable cleaning pad of claim 1, further including a foot that (a) normally resides within said enclosure between said upper and lower panels when said width-expanding means is expanded against said inside of said cleaning pad, and (b) extends from said second end of said enclosure in response to said width-expanding means being withdrawn from said inside of said cleaning pad so that when said width-expanding means withdrawn from said inside of said cleaning pad, said foot urges said cleaning pad at least partially off said mop head.

6. The mop head and removable cleaning pad of claim 1 wherein said thickness-expanding means comprises expanding means inside said enclosure for expanding said upper and lower panels further apart against the inside of the cleaning pad so as to increase the thickness of said enclosure and secure said cleaning pad to said enclosure.

7. The mop head and removable cleaning pad of claim 6 wherein said thickness-expanding means also includes:

a hinged portion that joins said upper and lower opposing panels at said second ends of said panels, a pivot secured to said lower panel near its second end, a lever that rotates about said pivot and extends from said pivot to said first ends of said panels, a wedge secured to said lower panel near said first end of said lower panel and arranged so that said portion of said lever adjacent said wedge is slidably movable onto and off said wedge, said lever and said upper and lower panels of said enclosure being arranged so that when said lever is moved off said wedge, said upper and lower panels of said mop head are in contact, and when said lever is moved onto said wedge it urges said upper and lower panels of said mop head apart at said second ends of said panels, whereby when said lever is moved off of said wedge said cleaning pad can be slid over said mop head, open end first, so that it will conformingly fit over said mop head, and then when said lever is moved onto said wedge said upper and said lower panels of said mop head are urged apart, thereby stretching said cleaning pad taut at said second ends of said panels so as to secure said cleaning pad onto said mop head.

8. The mop head and removable cleaning pad of claim 6 wherein said securing mechanism further includes a manually operable member extending from said pad-holding enclosure, said thickness-expanding means being responsive to movement of said manually operable member for expanding said panels further apart.

9. The mop head and removable cleaning pad of claim 6 wherein said thickness-expanding means is arranged to expand said panels so that they define an acute angle therebetween when expanded.

10. The mop head and removable cleaning pad of claim 1 wherein said elongated handle is pivotably attached to said one of said ends of said enclosure so that said enclosure can be pivotably rotated around an axis extending between said first and second opposite ends of said enclosure such that both surfaces of said cleaning pad can be used.

11. The mop head and removable cleaning pad of claim 10 wherein said axis is spaced from a centerline of said upper and lower panels so that, when said mop head is lifted above a surface, gravitational force will urge said head to rotate so that one side thereof hangs downward.

12. The mop head and removable cleaning pad of claim 11 wherein said panels and said cleaning pad increase in width in a direction from said other end to said one end of said enclosure.

13. A mop head and a removable cleaning pad therefor, comprising, (a) a mop head comprising a pad-holding enclosure having generally parallel flat upper and lower opposing panels, each of said panels having (1) first and second opposite ends, (2) first and second opposite sides, (3) a relatively long length extending between said first and second opposite ends, and (4) a relatively short width extending between said first and second opposite sides, (b) said enclosure having (1) a thickness between said upper and lower panels that is less that said width, (2) a first end extending between said first ends of said panels, (3) a second opposite end extending between said second ends of said panels, (4) a length between said first and second ends of said panels, (5) a first side extending between said first sides of said panels, and (6) a second opposite side extending between said second sides of said panels, (b) an elongated handle pivotally attached to said first end of said enclosure, said handle being perpendicular to said length of said enclosure, and (c) a cleaning pad comprising a sleeve of flexible material having upper and lower surfaces with first and second ends, said first end being open and said second end being closed or fastened, said sleeve being sized and shaped so that (a) said first and open end can be slid over the length of said enclosure from said second end of said enclosure, and (b) said cleaning pad will conformingly fit over and cover or enclose said enclosure with said upper surface of said cleaning pad adjacent and covering substantially said entire upper panel of said enclosure and said lower surface of said cleaning pad adjacent and covering substantially said entire lower panel of said enclosure, (d) said enclosure having a securing mechanism for selectively either (a) securing said cleaning pad to said enclosure for preventing said cleaning pad from sliding off said enclosure after it is fit over and covers or encloses said enclosure, or (b) allowing said cleaning pad to slide off said enclosure, (e) said securing mechanism comprising width-expanding means for expanding at least one of said sides of said enclosure out against an inside of said cleaning pad so as to increase the width of said pad-holding enclosure and thereby secure said cleaning pad to said enclosure, and (f) means for manually operating said securing mechanism from outside said enclosure and cleaning pad for causing it to either (1) hold said cleaning pad secured to said enclosure or (2) release said cleaning pad so that it can be slid off said enclosure.

14. The mop head with a removable cleaning pad of claim 13, further including an ejection foot that normally resides within said enclosure between said upper and lower panels when said width-expanding means is expanded against said inside of said cleaning pad, and extends from said second end of said enclosure in response to said width-expanding means being withdrawn from said inside of said cleaning pad so that when said width-expanding means withdrawn from said inside of said cleaning pad, said foot urges said cleaning pad at least partially off said mop head.

15. The mop head with a removable cleaning pad of claim 13 wherein said width-expanding means comprises a plurality of fingers that are urged outward from said one of said sides of said holding enclosure and against said inside of said cleaning pad so that said cleaning pad will not be removable from said mop head.

16. The mop head with a removable cleaning pad of claim 13 wherein said enclosure and said cleaning pad decrease in width in a direction from said first end to said second end of said enclosure.

17. The mop head with a removable cleaning pad of claim 13 wherein said elongated handle is pivotably attached to said first end of said enclosure so that said enclosure can be pivotably rotated around an axis extending between said first and second opposite ends of said enclosure such that both surfaces of said cleaning pad can be used, and wherein said axis is spaced from a centerline of said upper and lower panels so that, when said mop head is lifted above a surface, gravitational force will urge said head to rotate so that one side thereof hangs downward.

18. A method of attaching a cleaning pad to a mop head, comprising:

(a) providing a mop head comprising a pad-holding enclosure having generally parallel upper and lower opposing panels, each of said panels having a relatively long length extending between first and second opposite ends of said panels and a relatively short width extending between first and second opposite sides of said panels, (b) said enclosure having a thickness between said upper and lower panels that is less than said width of said panels, said enclosure having a first end extending between said first ends of said panels and a second and opposite end extending between said second ends of said panels, (c) providing an elongated handle pivotally attached to said first end of said enclosure, said handle being perpendicular to said length of said enclosure, (d) providing a cleaning pad comprising a sleeve of flexible material having upper and lower surfaces with one closed or fastened end and an opposite open end, said sleeve being sized and shaped so that (1) its open end can be slid over said second end of said enclosure and then the length of enclosure, and (2) said cleaning pad will conformingly fit over and cover or enclose said enclosure with said upper surface of said cleaning pad covering substantially said entire upper surface of said upper panel and said lower surface of said cleaning pad covering substantially said entire lower panel of said enclosure, (e) sliding said open end of said cleaning pad over said second end of said enclosure and then the length of enclosure so that said cleaning pad will conformingly fit over and cover or enclose said enclosure with said upper surface of said cleaning pad covering said upper panel of said enclosure and said lower surface of said cleaning pad covering said lower panel of said enclosure, and (e) providing said enclosure with manually activatable securing means for selectively either (1) securing said cleaning pad to said pad-holding enclosure for preventing said cleaning pad from sliding off said enclosure after it is fit over and covers or encloses said enclosure, or (2) allowing said cleaning pad to slide off said enclosure (f) said securing mechanism being selected from the group consisting of (A) width-expanding means for expanding at least one of said sides of said enclosure out against an inside of said cleaning pad so as to increase the width of said enclosure, and (B) thickness-expanding means for expanding said flat or planar parallel upper and lower opposing panels further apart so as to increase the thickness of said pad-holding enclosure, thereby to secure said cleaning pad to said pad-holding enclosure, and (g) manually activating said securing means for securing said cleaning pad to said enclosure.

19. The method of attaching a cleaning pad to a mop head of claim 18, further including providing a foot that (a) normally resides within said housing between said upper and lower panels when said manually activatable securing means is expanded against said inside of said cleaning pad, and (b) is extendable from said mop head when said manually activatable securing means is not expanded against said inside of said cleaning pad so that when said manually activatable securing means is not expanded against said inside of said cleaning pad, said foot urges said cleaning pad off said mop head.

20. The method of attaching a cleaning pad to a mop head of claim 19 wherein said providing said enclosure with securing means comprises:

providing a hinged portion that joins said upper and lower opposing panels at said second ends of said panels, providing a pivot secured to said lower panel of said enclosure near said second end of said panels, providing a lever that rotates about said pivot and extends from said pivot to sid first end of said enclosure, and providing a wedge secured to said lower panel near said first end of said lower panel and arranged so that said portion of said lever adjacent said wedge is slidably movable onto and off of said wedge, and arranging said lever and said upper and lower panels so that when said lever is moved off said wedge, said upper and lower panels are relatively close, and when said lever is moved onto said wedge, said upper and lower panels at said first ends of said panels are urged apart, whereby when said lever is moved off of said wedge, said cleaning pad can be slid over said mop head, open end first, so that it will conformingly fit over said enclosure, and when said lever is moved onto said wedge said upper and said lower panels are urged apart, thereby stretching said cleaning pad taut at said second end of said length, thereby securing said cleaning pad onto said enclosure.

* * * * *